US008225604B2

(12) United States Patent
Kim

(10) Patent No.: US 8,225,604 B2
(45) Date of Patent: Jul. 24, 2012

(54) SHOCK ABSORPTION DEVICE AND CONTROL METHOD THEREOF FOR SMALL SWING RADIUS EXCAVATOR

(75) Inventor: Dong Soo Kim, Jinhae (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 821 days.

(21) Appl. No.: 12/327,155

(22) Filed: Dec. 3, 2008

(65) Prior Publication Data

US 2009/0151346 A1 Jun. 18, 2009

(30) Foreign Application Priority Data

Dec. 17, 2007 (KR) ..... 10-2007-0132467

(51) Int. Cl.
*E02F 9/20* (2006.01)
*F15B 11/048* (2006.01)

(52) U.S. Cl. ..... 60/426; 60/446

(58) Field of Classification Search ..... 60/426, 60/445, 446, 486
See application file for complete search history.

(56) References Cited

U.S. PATENT DOCUMENTS

| | | | | |
|---|---|---|---|---|
| 5,361,211 | A | 11/1994 | Lee et al. | |
| 5,950,430 | A * | 9/1999 | Tohji et al. | 60/426 |
| 2004/0128868 | A1 | 7/2004 | Helbling et al. | |
| 2007/0033934 | A1 * | 2/2007 | Yamazaki et al. | 60/459 |

FOREIGN PATENT DOCUMENTS

| | | |
|---|---|---|
| EP | 0 919 670 | 6/1999 |
| EP | 1 752 664 | 2/2007 |

* cited by examiner

*Primary Examiner* — Thomas E Lazo
(74) *Attorney, Agent, or Firm* — Ladas & Parry LLP

(57) ABSTRACT

A shock absorption device and a control method thereof for a small swing radius (SSR) excavator are provided, which can relieve shock generated on a boom cylinder by controlling only the discharge flow rate of hydraulic pumps, being supplied to the boom cylinder, even without controlling a main control valve when a boom of the excavator ascends at its maximum height through manipulation of a control level. The shock absorption device for an SSR excavator includes first and second hydraulic pumps, a control lever, a boom cylinder coupled to the first hydraulic pump, a main control valve for controlling a start, a stop, and a direction change of the boom cylinder, a boom-up manipulation amount detection means, a hydraulic pump flow computation means, a boom confluence means for making hydraulic fluid discharged from the first and second hydraulic pumps confluent together, a boom deceleration region detection means for detecting a boom deceleration region, and a flow controller for controlling the discharge flow rate of the first and second hydraulic pumps.

5 Claims, 4 Drawing Sheets

SHOCK ABSORPTION DEVICE AND CONTROL METHOD THEREOF FOR SMALL SWING RADIUS EXCAVATOR

CROSS-REFERENCE TO RELATED APPLICATION

This application is based on and claims priority from Korean Patent Application No. 10-2007-0132467, filed on Dec. 17, 2007 in the Korean Intellectual Property Office, the disclosure of which is incorporated herein in its entirety by reference.

BACKGROUND OF THE INVENTION

1. Field of the invention

The present invention relates to a shock absorption device and a control method thereof for a small swing radius excavator, which can relieve shock generated on a boom cylinder when a boom of the excavator ascends at its maximum height through manipulation of a control level by controlling the flow rate of hydraulic pumps, being supplied to the boom cylinder, and thus can secure the stability of the excavator.

2. Description of the Prior Art

Generally, a swing excavator is classified into a standard swing excavator and a small swing radius (SSR) excavator.

In the standard swing excavator, if an upper swing structure has a posture directed to a forward/backward direction against a lower driving structure (i.e. if a working device has a posture directed to the traveling direction of the lower driving structure), a rear end part of the upper swing structure projects to an outside so as to be longer than a front/rear part of the lower driving structure (i.e. an end part in a traveling direction). If the upper swing structure has a posture directed to a horizontal direction against the lower driving structure (i.e. if the working device has a posture directed to a direction perpendicular to the traveling direction of the lower driving structure), the rear end part of the upper swing structure projects to an outside so as to be longer than a left/right part of the lower driving structure (i.e. an end part in a direction perpendicular to the traveling direction).

Accordingly, since a distance from the rear end part of the upper swing structure to the swing center thereof is long and the rotational moment of the rear part of the upper swing structure becomes high, it is difficult that the rotational moment of the front part of the upper swing structure that is generated by the excavation force of the working device causes the overturning of the excavator. Accordingly, the excavator can provide a large excavation force, and thus the workability is improved.

As illustrated in FIG. 1, in the small swing radius (SSR) excavator, if the upper swing structure 2 has a posture directed to a forward/backward direction against the lower driving structure 1, the rear end part of the upper swing structure 2 is included in the front/rear part of the lower driving structure 1. If the upper swing structure 2 has a posture directed to the horizontal direction against the lower driving structure 1, the rear end part of the upper swing structure 2 is included in the left/right part of the lower driving structure 1.

In the drawing, unexplained reference numeral A denotes a working device, such as a boom, an arm, or a bucket, which is driven by a hydraulic cylinder, and B denotes a cab mounted on the upper swing structure 2.

Accordingly, since the rear end part of the upper swing structure 2 is included in the front/rear part and the left/right parts of the lower driving structure 1, it does not interfere with an obstacle near the lower driving structure 1, so that the stability is secured during the swing operation, and the operator's swing manipulation becomes excellent. Even if an obstacle exists near the lower driving structure 1, the upper swing structure 2 can perform the swing operation, and this facilitates the work in a narrow space.

In this case, the terms "front/rear part" and "left/right part" mean the direction or side based on the operator in the cab.

In order to reduce the swing radius of the working device, the swing excavator is provided with a boom cylinder having a length that is much larger than the length of a standard type excavator to extend the maximum angle of a boom. If the boom cylinder reaches the stroke end and is abruptly stopped while the boom cylinder is driven to make the boom ascend at its maximum height, shock is generated when the boom cylinder becomes in contact with a cushion plunger, and the endurance of the corresponding parts is lowered to shorten the life span thereof. Also, due to the cause in shape of the boom cylinder and the boom in the corresponding position, the stability of the equipment is lowered by such an abrupt stop of the boom cylinder.

In order to prevent the shock generation when the boom ascends at its maximum height, a proximity sensor for detecting the rotation angle of the boom cylinder may be installed in a specified position of the boom cylinder, and a separate driving device may be used to control the main control valve so that the main control valve controls the hydraulic fluid being supplied to the boom cylinder in accordance with the detection signal from the proximity sensor. In this case, however, the structure of the hydraulic circuit is complicated due to the increase of the corresponding parts, and thus the manufacturing cost is increased.

SUMMARY OF THE INVENTION

Accordingly, the present invention has been made to solve the above-mentioned problems occurring in the prior art, and an object of the present invention is to provide a shock absorption device and a control method thereof for a small swing radius (SSR) excavator, which can secure the stability of the excavator and simplify the construction of a hydraulic circuit by controlling only the discharge flow rate of hydraulic pumps, being supplied to a boom cylinder, even without controlling a main control valve when a boom of the excavator ascends at its maximum height through manipulation of a control level.

In order to accomplish the above and other objects, there is provided a shock absorption device for an SSR excavator, according to the present invention, which includes first and second hydraulic pumps coupled to an engine; a control lever for outputting a manipulation signal corresponding to an amount of manipulation by an operator; a boom cylinder coupled to the first hydraulic pump; a main control valve, installed in a path between the first hydraulic pump and the boom cylinder, for controlling a start, a stop, and a direction change of the boom cylinder during shifting; a boom-up manipulation amount detection means for detecting a boom-up signal pressure in accordance with an amount of manipulation of the control lever; a hydraulic pump flow computation means for computing the flow rate of the first and second hydraulic pumps required in accordance with the detected amount of boom-up manipulation; a boom confluence means for making hydraulic fluid discharged from the first and second hydraulic pumps confluent together in accordance with the flow rate computed by the hydraulic pump flow computation means during a boom-up manipulation through the control lever, and supplying the confluent hydraulic fluid to the boom cylinder; a boom deceleration region detection means for detecting a boom deceleration region in which deceleration of the boom cylinder is required if a rotation angle of a boom exceeds a preset rotation angle in a boom rotation region; and a flow controller for controlling the discharge flow rate of the first and second hydraulic pumps in accordance with a control signal from a control unit so as to decelerate the boom cylinder if the boom rotates over the preset rotation angle as a result of detection by the boom deceleration region detection means and thus the deceleration of the boom cylinder is required.

The boom deceleration region detection means may include a non-contact type proximity switch.

In another aspect of the present invention, there is provided a method of controlling a shock absorption device for an SSR excavator, including an engine, first and second hydraulic pumps, an engine speed setup means, a boom cylinder coupled to the first hydraulic pump, a main control valve for controlling hydraulic fluid being supplied to the boom cylinder, a control lever for outputting signal pressure corresponding to an amount of manipulation thereof, a flow controller for controlling the discharge flow rate of the first and second hydraulic pumps, a boom confluence means for making the hydraulic fluid discharged from the first and second hydraulic pumps confluent together, a boom-up manipulation amount detection means for detecting a boom-up signal pressure, a boom-up speed computation means for predicting a boom-up speed, a boom deceleration judgment means for judging whether the boom decelerates, and a deceleration flow computation means, which includes detecting boom-up signal pressure in accordance with the manipulation mount of the control lever; predicting the boom-up speed in accordance with output signals of the engine speed setting means and the boom-up manipulation amount detection means; detecting a boom deceleration region in which a rotation angle of a boom exceeds a preset rotation angle and deceleration of the boom cylinder is required in a boom rotation region; calculating the discharge flow rate of the first and second hydraulic pumps so as to decelerate the boom cylinder, without applying shock to the excavator, if the rotation angle of the boom exceeds the preset rotation angle; limiting the discharge flow rate of the first and second hydraulic pumps so that an output value of the boom-up speed computation means does not exceed an output value of the deceleration flow computation means from a time point when an output signal is generated from the boom deceleration judgment means if the output signal is generated from the boom deceleration judgment means; and determining whether to make the hydraulic fluid of the second hydraulic pump confluent in accordance with the limited discharge flow rate of the first and second hydraulic fluid.

The deceleration flow computation means may include a first pattern for reducing the hydraulic fluid being supplied to the boom cylinder from an initial time of the boom deceleration region to a specified time, and uniformly maintaining the hydraulic fluid being supplied to the boom cylinder after the specified time; and a second pattern for uniformly maintaining a flow rate that is higher than that of the first pattern from a specified section of the boom deceleration region to a stroke end of the boom cylinder, and selectively output any one of the first and second patterns in accordance with the output signal of the boom deceleration judgment means.

The boom deceleration judgment means may separately judge a case where a boom-up operation starts after the state of the output signal of the boom deceleration region detection means is changed into an on state and a case where the state of the output signal of the boom deceleration region detection means is changed into an on state during a boom-up operation, and output respective detection signals in accordance with the judged cases, respectively.

The discharge flow rate of the first and second hydraulic pumps may be limited in a manner that the discharge flow rate of the second hydraulic pump is first reduced, and then the discharge flow rate of the first hydraulic fluid is reduced.

The boom confluence means may output the control signal so that the confluent hydraulic fluid is cut off when the discharge flow rate of the second hydraulic pump reaches its minimum value.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
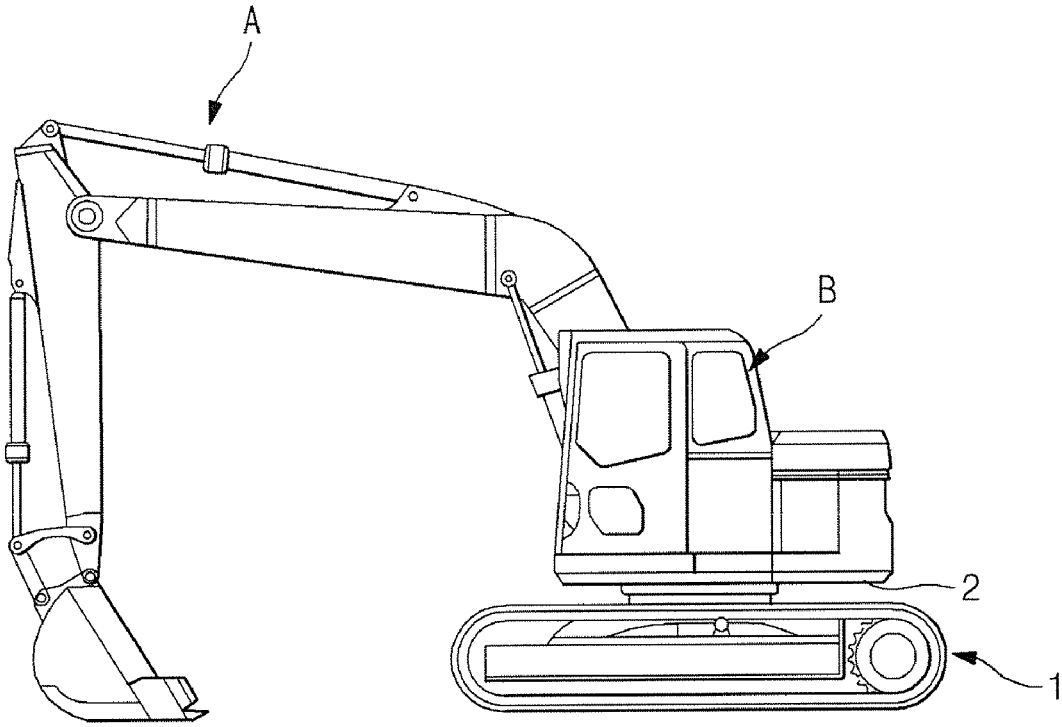
Fig. 1 Prior Art
FIG. 1 is a schematic view of a general small swing radius (SSR) excavator.
Figure 2:
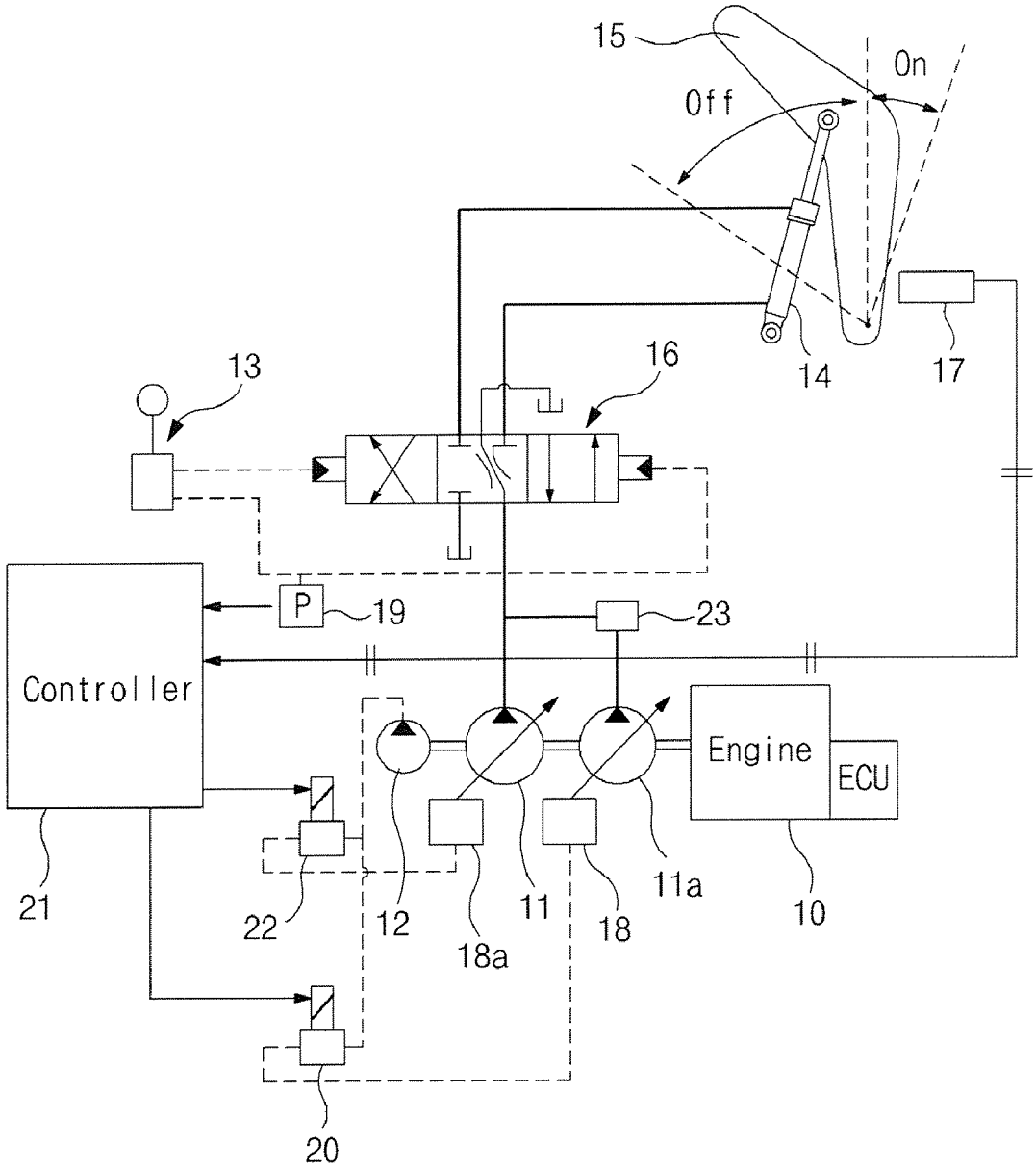
FIG. 2 is a schematic view illustrating the construction of a shock absorption device for an SSR excavator according to an embodiment of the present invention.
Figure 3A:
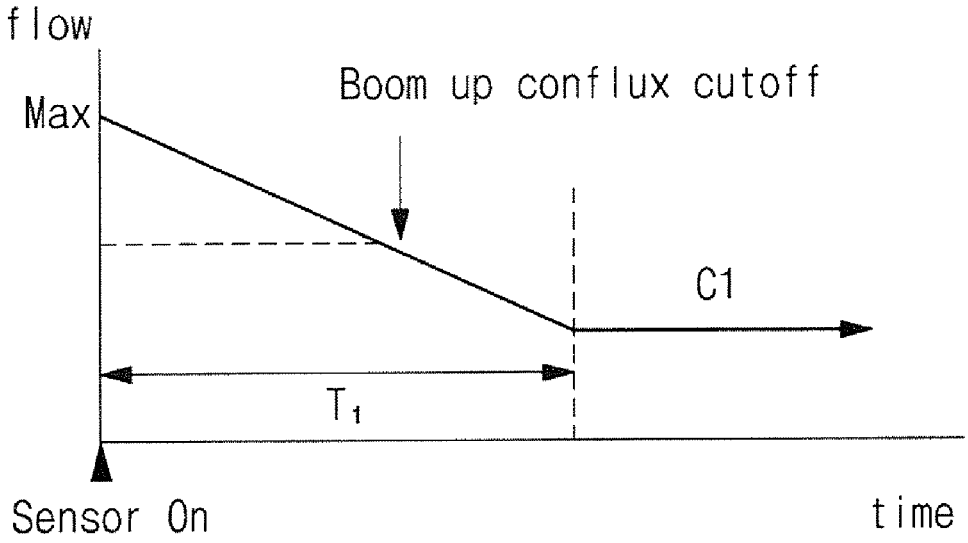
FIGS. 3A and 3B are graphs explaining a shock absorption device for an SSR excavator according to an embodiment of the present invention.
Figure 3B:
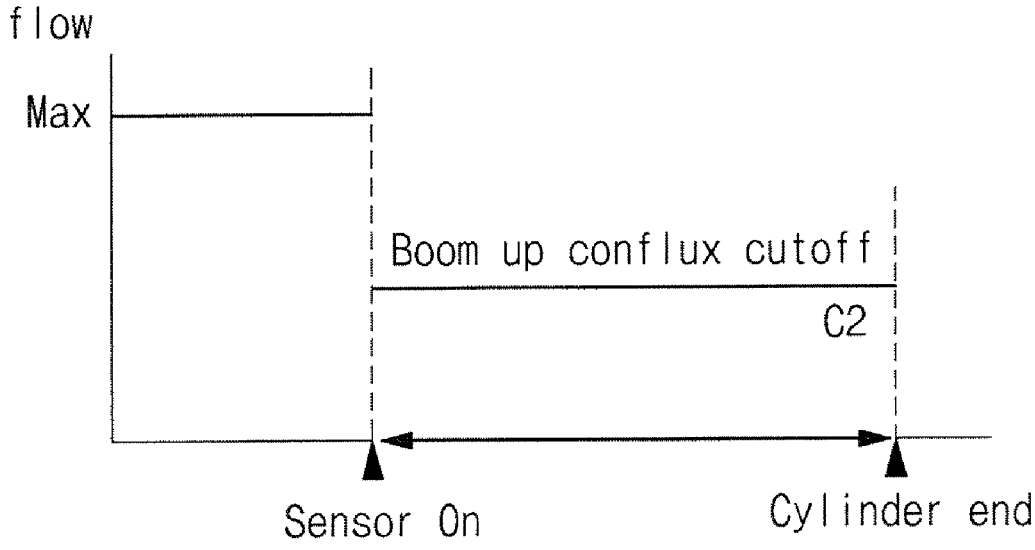

As illustrated in FIGS. 2, 3A and 3B, a shock absorption device for a small swing radius (SSR) excavator according to an embodiment of the present invention includes a first hydraulic pump 11, a second hydraulic pump 11*a*, and a pilot pump 12 coupled to an engine 10; a means for setting a speed of the engine 10 (not illustrated); a control lever 13 for outputting a manipulation signal corresponding to an amount of manipulation by an operator; a boom cylinder 14 coupled to the first hydraulic pump 11 and the second hydraulic pump 11*a* to drive a boom 15 when hydraulic fluid is supplied thereto; a boom confluence means 23 for making hydraulic fluid discharged from the first hydraulic pump 11 and the second hydraulic pump 11*a* confluent together in accordance with the amount of manipulation of the control lever 13 during a boom-up manipulation through the control lever 13, and supplying the confluent hydraulic fluid to the boom cylinder 14; a main control valve 16, installed in a path between the first hydraulic pump 11 and the boom cylinder 14, for controlling a start, a stop, and a direction change of the boom cylinder 14 during shifting in accordance with signal pressure from the control lever 13; a boom-up manipulation amount detection means 19 for detecting a boom-up signal pressure in accordance with the amount of manipulation of the control lever 19; a boom-up speed computation means for predicting a boom-up speed in accordance with output signals from the engine speed setting means and the boom-up manipulation amount detection means 19; a boom deceleration region detection means 17 for detecting a boom deceleration region in which deceleration of the boom cylinder 14 is required if the rotation angle of a boom 15 exceeds a preset rotation angle in a boom rotation region; a boom deceleration judgment means for judging whether the boom 15 is decelerated in accordance with output signals of the boom-up speed computation means and the boom deceleration region detection means 17; a deceleration flow computation means for calculating the boundary of the hydraulic fluid for decelerating the boom cylinder 14, without applying shock to the equipment, in accordance with an output signal of the boom deceleration flow computation means; and flow controllers 18 and 18*a* for controlling the discharge flow rate of the first and second hydraulic pumps 11 and 11*a* in accordance with a control signal from a control unit 21 so as to decelerate the boom cylinder 14 if the boom rotates over the preset rotation angle as a result of detection by the boom deceleration region detection means 17.

The boom deceleration region detection means may include a non-contact type proximity switch.

In the drawing, the reference numerals "20" and "22" denote proportional control valves for supplying the pilot signal pressure of the pilot pump 12 to the flow controllers 18 and 18*a* (which are swash plate angle adjustment tools of the hydraulic pumps) in accordance with the control signal from the control unit 21.

Hereinafter, the operation of the shock absorption device for an SSR excavator according to an embodiment of the present invention will be described in detail with reference to the accompanying drawings.

As illustrated in FIG. 2, if the pilot signal pressure is supplied from the pilot pump 12 to a right end side of the main control valve 16 through manipulation of the control lever 13, a spool is shifted to a left direction as shown in the drawing. The hydraulic fluid discharged from the first and second hydraulic pumps 11 and 11*a* is supplied to a large chamber of the boom cylinder 14 via the main control valve 16 to expand the boom cylinder 14.

At this time, the hydraulic fluid discharged from a small chamber of the boom cylinder 14 returns to a hydraulic tank via the main control valve 16.

If the pilot signal pressure is supplied to the left end side of the main control valve 16 through manipulation of the control lever 13, the spool is shifted to the right direction as shown in the drawing. The hydraulic fluid discharged from the first and second hydraulic pumps 11 and 11*a* is supplied to the small chamber of the boom cylinder 14 via the main control valve 16 to contract the boom cylinder 14.

At this time, the hydraulic fluid discharged from the large chamber of the boom cylinder 14 returns to the hydraulic tank via the main control valve 16.

The boom-up manipulation amount detection means 19 (e.g., a pressure sensor) installed in a pilot signal pressure supply line that expands the boom cylinder 14 detects the boom-up signal pressure and supplies the detected boom-up signal pressure to the control unit 21.

The control unit 21 computes the flow rate of the first and second hydraulic pumps 11 and 11*a* required in accordance with the detected pressure signal. The control unit 21 sets the flow rate of the first hydraulic pump 11 and the flow rate of the second hydraulic pump 11*a* in accordance with the computed flow rate, and if the flow rate of the first hydraulic pump 11 becomes maximum, it turns on the boom confluence means 23 to make the flow rate of the second hydraulic pump 11*a* confluent together.

If the rotation angle of the boom 15 exceeds the preset rotation angle in the rotation region of the boom 15, the boom deceleration region detection means 17 (e.g. a non-contact type proximity switch) detects this and supplies the detected signal to the control unit 21.

Accordingly, if it is judged that the rotation angle of the boom 15 exceeds the preset rotation angle, the control unit 21 limits the computed pump flow rate to decelerate the boom cylinder 14, while otherwise, it output the previously computed pump flow rate as a control signal.

The control unit 21 limits the pump flow rate through comparison of the whole flow rate. That is, the flow rate of the confluence side is first reduced, and if the flow rate of the second hydraulic pump 11*a* of the confluence side is at minimum, the confluent hydraulic fluid is cut off by the boom confluence means 23. Thereafter, the flow rate of the first hydraulic pump 11 is reduced.

The pilot signal pressure discharged from the pilot pump 12 is supplied to the flow controllers 18 and 18*a* by the proportional control valves 20 and 22 which are driven by the control signal from the control unit 21. By controlling the inclination angle of the swash plates of the first and second hydraulic pump 11 and 11*a*, the flow controllers 18 and 18*a* can control the discharge flow rate of the first and second hydraulic pumps 11 and 11*a*.

Accordingly, if the rotation angle of the boom 15 exceeds the preset rotation angle as a result of detection by the boom deceleration region detection means 17, the discharge flow rate of the first and second hydraulic pumps 11 and 11*a*, being supplied to the boom cylinder 14, is reduced, even without controlling the main control valve 16 to reduce the hydraulic fluid being supplied to the boom cylinder 14, and thus the shock generated during the stroke end of the boom cylinder 14 is reduced.

Figure 4:
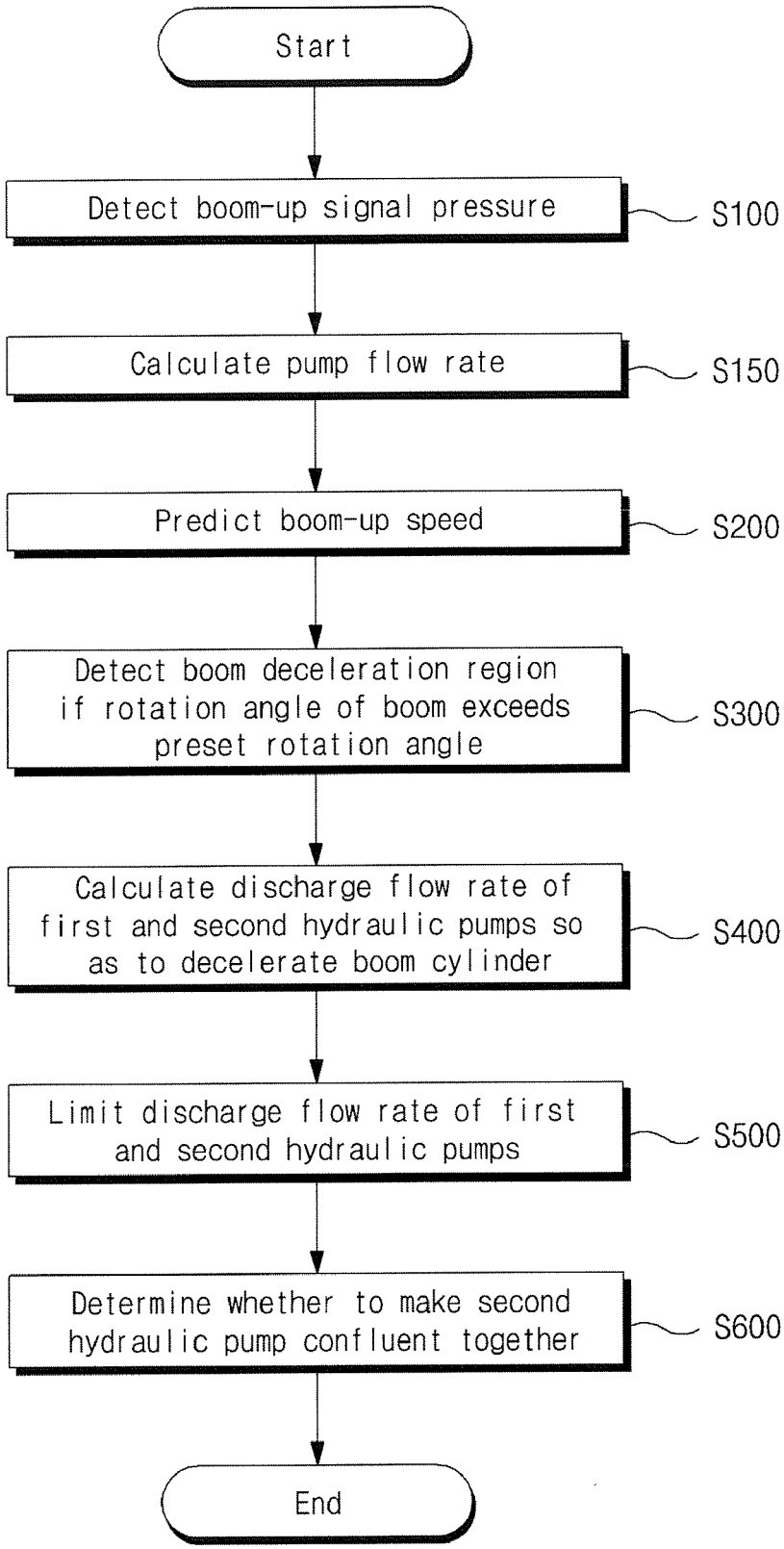
FIG. 4 is a flowchart illustrating a method of controlling a shock absorption device for an SSR excavator according to an embodiment of the present invention.

FIG. 4 is a flowchart illustrating a method of controlling a shock absorption device for an SSR excavator according to an embodiment of the present invention.

In the case of expand the boom cylinder 14 through user's manipulation of the control lever 13 in step S100, the boom-up signal pressure is detected by the boom-up manipulation amount detection means 19 installed in the pilot signal line of the main controller 16, and the detected signal pressure is transferred to the control unit 21.

In step S150, the discharge flow rate of the first and second hydraulic pumps 11 and 11*a* corresponding to the detected signal pressure is computed.

In step S200, the boom-up speed is predicted by the output signals from the engine speed setting means and the boom-up manipulation amount detection means 19.

In step S300, if the rotation angle of the boom 15 exceeds the preset rotation angle due the driving of the boom cylinder 14, the boom deceleration regions (indicated as "Off" region and "On" region in FIG. 2), in which deceleration of the boom cylinder 14 is required, are detected by the boom deceleration region detection means 17, and the output signal of the boom deceleration region detection means 17 is transferred to the control unit 21.

In step S400, if the deceleration of the boom cylinder 14 is required by the output signal of the boom deceleration region detection means 17, the boundary of the hydraulic fluid is calculated so as to decelerate the boom cylinder 14, without applying shock to the equipment.

At this time, as illustrated in FIG. 3A, the hydraulic fluid being supplied to the boom cylinder 14 is reduced from the initial time of the boom deceleration region to a specified time $T_1$, and thereafter, the hydraulic fluid being supplied to the boom cylinder 14 is uniformed maintained (indicated by "C1" in FIG. 3A) (which is called a "first pattern).

As illustrated in FIG. 3B, a relatively large amount of hydraulic fluid, in comparison to the hydraulic fluid in the first pattern, can be uniformly maintained (indicated by "C2") from the specified section of the boom deceleration region to the stroke end of the boom cylinder 14 (indicated as "On" region) (which is called a "second pattern").

One of the first and second patterns is selectively outputted in accordance with the output signal of the boom deceleration judgment means.

At this time, a case where the boom-up operation starts after the state of the output signal of the boom deceleration region detection means 17 is changed into an on state and a case where the state of the output signal of the boom deceleration region detection means is changed into an on state during the boom-up operation are separately judged, and respective detection signals are outputted in accordance with the judged cases, respectively.

In this case, optimum values of parameters, such as C1, C2, $T_1$, and the like, can be found by tuning through experiments.

In step S500, if no output signal is generated from the boom deceleration judgment means, the flow rate of the hydraulic pumps computed in step S150 is outputted as it is.

In the case where the output signal is generated from the boom deceleration judgment means, the discharged flow rate of the first and second hydraulic pumps 11 and 11*a* is limited so that the output value of the boom-up speed computation means does not exceed the output value of the deceleration flow computation means from the time point when the output signal is generated.

At this time, the discharge flow rate of the second hydraulic pump 11*a* is first reduced, and then the discharge flow rate of the first hydraulic pump 11 is reduced.

In step S600, it is determined whether to make the hydraulic fluid discharged from the second hydraulic pump 11*a* confluent together in accordance with the limited discharge flow rate of the first and second hydraulic pumps 11 and 11*a*. In this case, when the discharge flow rate of the second hydraulic pump 11*a* reaches the minimum value, the control signal is outputted to cut off the confluence.

As described above, the shock absorption device for an SSR excavator according the present invention has the following advantages.

Since the driving of the boom cylinder is controlled by controlling the discharge flow rate of the hydraulic pumps being supplied to the boom cylinder, even without controlling the main control valve, when the boom of the excavator ascends at its maximum height through manipulation of the control lever, the construction of the hydraulic circuit is simplified with the manufacturing cost reduced, and the stability of the excavator is secured to heighten the reliability.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A method of controlling a shock absorption device for a small swing radius (SSR) excavator, including an engine, first and second hydraulic pumps, a boom cylinder coupled to the first hydraulic pump, a main control valve for controlling hydraulic fluid being supplied to the boom cylinder, a control lever for outputting signal pressure corresponding to an amount of manipulation thereof, a flow controller for controlling the discharge flow rate of the first and second hydraulic pumps, a boom confluence means for making the hydraulic fluid discharged from the first and second hydraulic pumps confluent together, a boom-up manipulation amount detection means for detecting a boom-up signal pressure, a boom-up speed computation means for predicting a boom-up speed, a boom deceleration judgment means for judging whether the boom decelerates, and a deceleration flow computation means, the method comprising:

detecting boom-up signal pressure in accordance with the manipulation amount of the control lever;

predicting the boom-up speed in accordance with the engine speed and output signals of the boom-up manipulation amount detection means;

detecting a boom deceleration region in which a rotation angle of a boom exceeds a preset rotation angle and deceleration of the boom cylinder is required in a boom rotation region;

calculating the discharge flow rate of the first and second hydraulic pumps so as to decelerate the boom cylinder, without applying shock to the excavator, if the rotation angle of the boom exceeds the preset rotation angle;

limiting the discharge flow rate of the first and second hydraulic pumps so that an output value of the boom-up speed computation means does not exceed an output value of the deceleration flow computation means from a time point when an output signal is generated from the boom deceleration judgment means if the output signal is generated from the boom deceleration judgment means; and determining whether to make the hydraulic fluid of the second hydraulic pump confluent in accordance with the limited discharge flow rate of the first and second hydraulic fluid.

2. The method of claim 1, wherein the deceleration flow computation means comprises:

a first pattern for reducing the hydraulic fluid being supplied to the boom cylinder from an initial time of the boom deceleration region to a specified time, and uniformly maintaining the hydraulic fluid being supplied to the boom cylinder after the specified time; and a second pattern for uniformly maintaining a flow rate that is higher than that of the first pattern from a specified section of the boom deceleration region to a stroke end of the boom cylinder;

wherein the deceleration flow computation means selectively outputs any one of the first and second patterns in accordance with the output signal of the boom deceleration judgment means.

3. The method of claim 1, wherein the boom deceleration judgment means separately judges a case where a boom-up operation starts after the state of the output signal of the boom deceleration region detection means is changed into an on state and a case where the state of the output signal of the boom deceleration region detection means is changed into an on state during a boom-up operation, and outputs respective detection signals in accordance with the judged cases, respectively.

4. The method of claim 1, wherein the discharge flow rate of the first and second hydraulic pumps is limited in a manner that the discharge flow rate of the second hydraulic pump is first reduced, and then the discharge flow rate of the first hydraulic fluid is reduced.

5. The method of claim 1, wherein the boom confluence means outputs the control signal so that the confluent hydraulic fluid is cut off when the discharge flow rate of the second hydraulic pump reaches its minimum value.

* * * * *